United States Patent [19]

Bretts et al.

[11] 4,128,459

[45] Dec. 5, 1978

[54] CONTINUOUS ELECTROPLATING OF ALLOY ONTO METALLIC STRIP

[75] Inventors: Gerald R. Bretts, Livingston; Dirk A. Timan, Morristown both of N.J.

[73] Assignee: Allied Chemical Corporation, Morris Township, Morris County, N.J.

[21] Appl. No.: 854,557

[22] Filed: Nov. 25, 1977

[51] Int. Cl.[2] ..... C25D 7/06; C25D 17/00

[52] U.S. Cl. ..... 204/28; 204/206; 204/207

[58] Field of Search ..... 204/28, 206–211

[56] References Cited

U.S. PATENT DOCUMENTS 2,657,177 10/1953 Rendel ..... 204/211

3,896,010 7/1975 Vetter ..... 204/206

*Primary Examiner*—John H. Mack

*Assistant Examiner*—William Leader

*Attorney, Agent, or Firm*—Horst M. Kasper

[57] ABSTRACT

A method of continuously electroplating alloys onto strip and wire. The strip is moved in an essentially mirror symmetrical path through the plating bath with the anode generally bisected by the mirror plane. The distance between anode and strip is smaller within the mirror plane, and larger at strip positions removed from the mirror plane, resulting in essentially uniform current density over the length of the strip immersed in the plating bath and in a homogeneous composition of the plated surface layer.

9 Claims, 1 Drawing Figure

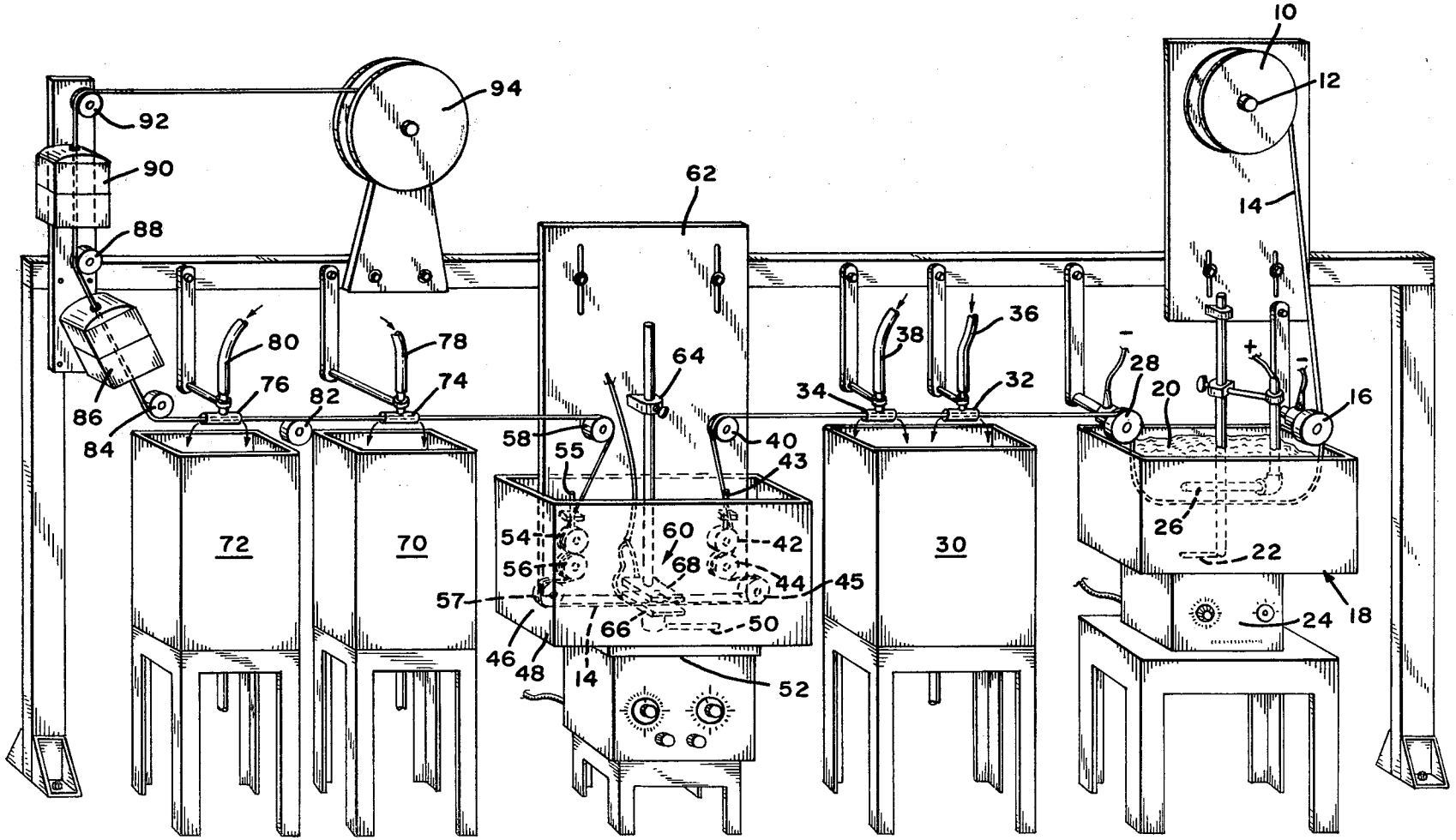
10
12
14
16
18
20
22
24
26
28
30
32
34
36
38
40
42
43
44
45
46
48
50
52
54
55
56
57
58
60
62
64
66
68
70
72
74
76
78
80
82
84
86
88
90
92
94

CONTINUOUS ELECTROPLATING OF ALLOY ONTO METALLIC STRIP

BACKGROUND OF THE INVENTION

The electroplating of metal alloys onto crystalline metal wire and strip is a well known, routinely practiced process. As the cross-sectional area of the strip to be plated decreases, the electrical resistance thereof increases and the problem arises of producing a satisfactory deposit of ungraded alloy composition. The discharge potential for each cation contained in an alloy to be deposited is different, and, furthermore, different cations have different mobility in a plating bath depending on factors such as temperature, viscosity, etc. Therefore, if the current density along the surface of the work piece to be plated varies, the composition of the deposited alloy also varies. Furthermore, not only the composition varies, but also the thickness of the deposited layer depends on the current density at the interface of electrolyte and work piece.

In the case of most objects which are electroplated, the cross-sectional area and resistivity are such that the potential drop between the electrical connection through the object and along the surface to be plated is negligibly small for the current employed under usual plating conditions. Therefore, the current density at all points of the surface is essentially uniform and hence, the composition of the deposit is practically uniform. However, with high electrical resistivity (e.g., larger than $50 \times 10^{-6}$ ohm-cm) and/or a small cross-section areas (e.g., smaller than $10^{-4}$ in$^2$ of the objects being plated), the electrical potential drop along the length of the object extending from the cathode contact becomes significant and hence, the current density is different at each point wetted by the plating bath. Under these conditions, a deposit of variable plating composition results over the surface area of the work piece.

One possible solution to this problem is to immerse only a very short length of the work piece at one time in the plating bath to minimize the potential difference in the immersed strip length. The amount of material deposited depends directly on the time of immersion for each point of the strip. The disadvantage of such an approach is the low speed required to allow the desired amount of alloy to be deposited along the work piece.

It is known to employ plating baths of high throwing power to obtain even metal distribution over the cathode area. However, the chemical methods employed in improving the throwing power are presently not sufficient to allow a uniform alloy composition being deposited over a high resistivity wire.

Methods and electrolytes for electroplating alloys, such as brass, as well known in the art. For instance, Lisewaki et al. in U.S. Pat. No. 3,620,937 describes a method and electrolyte for electroplating brass.

SUMMARY OF THE INVENTION

In accordance with the invention for continuously electroplating an alloy onto electrically conductive strip, especially a strip of metallic glass, an anode is placed into plating bath adapted to electrochemically deposit an alloy therefrom and said anode is connected to a positive potential. The strip is transported submerged through the bath. The path of the strip through the bath has a mirror plane lying normal to the surface of the bath and to the direction of movement of said strip and the anode is generally bisected by the mirror plane. A negative potential is applied to the strip at at least two points about equidistant from and on opposite sides of the anode and the anode extends in the direction of movement of the strip not more than about 15 percent of the length of the strip submerged in the bath. The distance between the anode and the strip is smaller within the mirror plane and increases progressively at strip portions removed from the mirror plane.

Prior to plating, the strip may optionally be etched, desirably by contacting the metallic glass with hydrofluoroboric acid, followed by rinsing. Alternatively, the strip can be etched prior to plating by contacting it with a nonoxidizing inorganic acid containing chloride ions while applying a negative potential to the strip.

The invention further provides apparatus for continuously electroplating an alloy onto electroconductive strip comprising a plating bath adapted to electrochemically deposit an alloy therefrom, an anode placed within the plating bath, means for transporting the electroconductive strip through the plating bath along a mirror symmetrical path with the mirror plane lying normal to the surface of the bath and to the direction of movement of said strip and having the anode generally bisected by said mirror plane, and contact means for applying a negative potential to the strip at at least two points about equidistant from and on opposite sides of the anode, wherein the anode extends in the direction of movement of the strip not more than about 15 percent of the strip submerged in the bath. The distance of the points of the strip submerged in the bath to the anode is a monotonically increasing function beginning at the point closest to the anode.

The invention provides as an article of manufacture a metallic glass strip plated with an alloy. Preferably the metallic glass is composed of 60–95 atomic % transition metal with the remainder being a light polyvalent nonmetal. A preferred plating alloy is brass or an alloy comprising about 50–80 atom percent copper and 20–50 atom percent zinc.

BRIEF DESCRIPTION OF THE DRAWING

The drawing shows a perspective elevation view of an apparatus of the present invention for continuously electroplating an alloy onto a continuous strip.

DETAILED DESCRIPTION OF THE INVENTION

The terms strip and wire are hereinafter used interchangeably and include strip, wire, band, thread, rod, string, tape, cable, etc. In accordance with the invention process, a strip is fed through an alloy plating bath over contacts applying an electrical potential, or mechanical restrictions determining its path. Electric contacts applying a negative electrical potential to the strip may serve as guides near the entrance point and near the exit point of the strip to and from the plating bath. The positive potential for plating is imparted to the solution by an anode which is placed essentially transverse to the path of the strip within the bath. Desirably, the distance between the anode and the strip is kept small in comparison to the distance between the anode and the contacts applying a negative potential to the strip, to keep the potential drop in the plating solution in the short distance between the anode and the strip small and of the order of a factor of perhaps about 10 less than the potential drop in the plating bath between the anode and the entrance and exit point potential of the strip. The potential drop between anode and cathode is the sum of the potential drop from the anode through the plating bath to any point at the strip and from that point on the strip to the contact point. Preferably the distance of the points of the strip to the anode is a monotonically increasing function beginning at the point closest to the anode for each strip piece immersed in the bath. The strip is preferably guided by rotatable contacts. The anode preferably surrounds the strip and covers an angle preferably exceeding 240°. More preferred the anode completely surrounds the strip e.g. in a ring shape or in a square or any body forming a topological torus. Preferably such body is provided with an opening for providing the additional possibility of introducing the strip from the periphery of the torus. Such opening can be provided by expanding the torus at the opening against its elastic resistance or by providing a hinged clasp.

In the present arrangement, the potential gradient in the plating bath near the strip is essentially constant over the whole length of the immersed strip and this results in a uniform current density through a double layer around the strip, thereby providing for deposition of an alloy of a homogeneous composition. According to H. von Helmholtz, an electrical double layer is generally formed at the surface separation between two phases and this double layer can be described by the electrokinetic or zeta potential. With this arrangement, it is possible to alloy-plate strip with very high resistivity such as 180 micro-ohms/cm$^2$ because constant current density can be maintained along the length of the strip. The immersion length of the strip in the bath is not critical, but relatively short immersion lengths of from about 3 to about 20 inches, preferably from about 6 to about 10 inches are desirable.

When plating alloys, the composition of the plated material depends on the current density at the cathode surface. At low current densities the more noble metal is deposited preferentially, and at high current densities the deposit corresponds more closely to the relative concentration of the metals in the bath. With the arrangement of the present invention, one can approach an asymptotic value of composition determined by the concentration in the bath and keep the composition constant over time and over the length of the immersed strip in the plating bath.

An additional improvement can be obtained by placing shields between anode and cathode which restrict the current density in the plating bath and increase the potential drop where desired. Such shields can be made from plastic materials. However, it is not necessary to apply shields to achieve the full impact of the present invention.

In general, the present invention is suitable for alloy plating of electroconductive strips made of material having relatively high resistivity, e.g. 10 to 200 microohms/cm$^2$. It is particularly suitable for alloy plating of such strip having small cross section of between about 0.005 mm$^2$ and 0.05 mm$^2$. Exemplary materials include the metallic glasses, stainless steel, Nichrome, Kanthal and similar high resistant alloy or metals.

A metallic glass is an alloy product of fusion which has been cooled to a rigid condition without crystallization. Such metallic glasses in general have at least some of the following desirable properties: high hardness and resistance to scratching, great smoothness of a glassy surface, dimensional and shape stability, mechanical stiffness, strength and ductility. Metallic glasses have a relatively high electrical resistance compared with related metals and alloys. They are characterized by having a diffuse X-ray diffraction pattern.

Any strip which has some electrical conductivity, though it may be low, can be plated according to the method of the present invention. As a limit, the conductivity of the strip has to be higher than that of the plating bath.

The alloys suitable for the application of the present invention include many of the industrially used plating alloys. Such alloys have the purpose of imparting to the strip or wire desirable properties including corrosion resistance, improved mechanical properties, improved adhesion, improved optical properties and better workability. Such alloys include, for example, lead-tin alloys; brass alloys which are copper-zinc alloys; bronze alloys which are copper-tin alloys; and alloys in the system silver-copper-tin. Brass is generally plated in a thickness of about 1 micron from a cyanide bath. The cyanide baths require careful control for maintaining uniform color and composition. Parameters to be controlled include the chemical composition of the bath, the temperature of the bath, the pH of the bath, and the freedom of the bath from colloidal and coagulated material. Particularly useful is the plating of carbon steel and of metallic glass wire which are suitable for use as belting material for automobile tires as described in Chemical and Engineering News, Nov. 19, 1973. The plating improves rubber adhesion for subsequent rubber applications. A deposit of 75% copper - 25% zinc alloy plate is known to improve adhesion of rubber, but compositions of 70% copper - 20% zinc have been employed. The pH must be maintained within a range of about 0.4 pH units in order to provide uniformity of plate composition. Electroplating alloys is also useful for the plating onto metals commonly used for electrical resistance elements. Brass plated resistance wire is provided with some protection against atmospheric corrosion.

In general, in electroplating of metals, the noblest metals are the ones which are deposited first and the less noble metals are plated last. Thus, in electroplating of alloys it is desirable that the relative electrochemical nobility of the metals is not too different. To obtain uniform comositions in alloy plating there should be a relatively high current density and the electrochemical potential of the metals making up the alloy with reference to the plating bath should be about equal. For instance, the system silver-copper-tin provides a well adapted system for plating onto strip according to the present invention.

In electroplating processes it is desirable that the surface to be presented to the plating bath is clean in order to assure uniform deposit and good adhesion between deposit and plating substrate. Usually, metal surfaces are to some degree oxidized, and soiled with various kinds of materials, typically, organic and acidic materials. Organic deposits on metal wires result, for instance, from lubricants used in wire drawing, wire handling and the like, and they can be removed with alkaline cleaners. In the case of glassy metals, no mechanical working has to be employed since such glassy metal is cast into final shape directly from the melt. Therefore, no organic soils are normally present on metallic glass wires or strips, and in this case there is usually no need to use an alkaline cleaner to remove organic materials from the surface.

Oxides on metallic surfaces may be removed by a variety of processes, which in general include an acid etching step. In the case of a fine wire or a thin strip, electrochemical etching is frequently employed wherein the substrate to be cleaned is made the electrode of an electrochemical cell. The substrate can be etched anodically or cathodically. It is preferable to have the substrate form the cathode in the etching bath because better plating deposits result. Suitable electrochemical etching solutions for cathodic etching comprise aqueous nonoxidizing inorganic acid solution containing chloride ions. Suitable nonoxidizing inorganic acids include sulfuric acid, phosphoric acid, hydrofluoroboric acid and the like. A specific example of a preferred aqueous etching solution is an about 1n aqueous $H_2SO_4$ solution containing in the order of about 5 weight percent added sodium chloride. In the case of a glassy metal, however, its high electrical resistivity makes the use of electrochemical etching less desirable due to the aforementioned problem of maintaining reasonably uniform current density for an effective approximately constant etching potential drop. We have found that glassy metal strips prior to electroplating, are effectively etched with a suitable acid, such as with hydrofluoroboric acid.

Following each of the etching and the plating operations, the metal strip should be thoroughly rinsed to remove the solutions employed in these operations. A water rinse is usually employed. Economical and environmental considerations make it desirable that the least quantity of rinse water be utilized in such an operation in order to minimize the amount of resulting waste fluid. Various rinsing methods employing countercurrent or agitated rinse water flow have been designed for that purpose. In general, the efficiency of a rinsing operation depends upon the concentration gradient of the material to be removed between the substrate surface and the rinse water. A countercurrent rinse system is in general the most efficient type.

It has been found that a simple "tee" tube arrangement can be employed to provide a countercurrent flow with a minimum of water consumption. In such an arrangement the strip to be rinsed passes through the straight section of the "tee", and the rinsing fluid is introduced through the side arm of the "tee. " There will be co-current flow in that arm of the "tee" pointing in the direction of strip movement and countercurrent flow in the arm pointing in the opposite direction. The amount of countercurrent flow is determined by the relative fluid resistance of the two arms in line of the "tee" and by the drag of the moving strip.

The present invention is further explained with reference to the embodiments represented in the drawing.

Referring now to the drawing, a storage spool 10 holding a conductive metal strip to be plated is rotatable around axis 12. Conductive metal strip 14 is fed from the storage spool 10 to a roll 16. Roll 16 has a metal surface which is connected to a negative electrical potential. Then the strip is passed through an etching bath 18 filled with an etching solution 20. The etching solution is agitated by a magnet 22 which is rotated by a magnetic field provided by a magnetic stirrer 24. An anode 26 for providing electrons to the solution is dipped into solution 20. The anode preferably is made of resistant material, e.g., stainless steel.

Downstream from the etching bath 18 the strip contacts cathode 28 which applies a negative charge to the strip as it leaves the etching bath.

In the above described optional electrochemical etching operation the strip forms the cathode of an electrochemical circuit. Depending on the etching solution and the voltage applied, oxygen or other electronegative radicals are formed on the surface of the strip, which have a cleaning effect on that surface.

If desired, purely chemical etching using a suitable etching solution may be employed. In that event it is not necessary to apply an electrical potential to the strip in the etching operation and the electrical contacts may be omitted.

Next the strip is rinsed to remove adhering etching solution. To that end the strip is passed through a series of two "tees" 32,34 located over catch basin 30 wherein it is contacted with water.

The strip passes through the straight arms of the "tee". Water (or any desired rinsing solution) is introduced through the remaining opening via flexible hoses 36 and 38 and then flows out at the entrance and exit port of the strip. This provides some counter-stream rinsing of the strip.

The next step is the plating operation. The strip is guided over roll 40 and into the nip between rolls 42 and 44. A negative potential is applied at roll 44. Then the strip is guided by a guide 45 into the plating solution 46 contained in vessel 48. The plating solution 46 is agitated by a swirling magnet 50 which is rotated by a magnetic stirrer 52. After passage over guide 57 the strip into the nip between roll 56 and guide roller 54 where a negative potential is applied. Then a guide roll 58 directs the wire to the following rinsing station. Negative potential is applied to the strip as it is running over and is pressed against brass rolls 44 and 56 by spring loaded rubber rolls 42 and 54. The negative potential is provided to the brass rolls 44 and 56 through spring loaded graphite brushes 43 and 55, respectively.

Preferably guides 40, 44, 56, 58, and contacts 42, 54 are mounted on a board 62 which can be raised and lowered into the plating solution. A separate clamping mechanism 64 is provided allowing to place the anode independently.

An anode 60 having the approximate composition of the plating is positioned within the plating bath.

Preferably the anode comprises two parallel arms 66 and 68, and the strip to be plated runs between these arms. A plating current of between about 1 to 4 amps and 5 to about 25 amps/dm$^2$ current density will usually result in satisfactory operation. This current density when used with the indicated plating solution causes a deposit with a morphology and composition for forming an adhesive bond stronger than the cohesive strength of natural rubber stock elastomers. An average current density of at least 5 amps/dm$^2$ is critical for obtaining a suitable deposit. Current densities below the value of about 6 amps/dm$^2$ result in a plated deposit which is less adherant to sufficiently strongly bond to the natural rubber and which results in adhesive failure of the rubber-plating bond, under testing. Higher current density than 25 amps/dm$^2$ can form satisfactory deposits, however heating of the bath caused by the power dissipated at these higher current densities causes chemical breakdown of the bath unless this heat is removed. The resulting deposit is between about 0.1 and 2 micron thick and preferably between about 0.2 and 1 micron.

The geometrical arrangement of strip, cathode contacts and anode are such that there arises essentially a middle plane in the center of the vessel which is normal to the plating solution surface and which images the entrance and exit paths of the strip within the plating bath. The anode 60 is placed essentially in the mirror plane. This results in a short distance between the anode and the strip when the strip is in the position of the mirror plane, and in a progressively longer distance between the strip and the anode at a positions progressively removed from the mirror plane, but still within the plating bath.

Thus, when the resistance along the strip from the point at which the negative potential is applied to the strip to a particular point in the bath at high, then the resistance between the same point and the anode within the plating solution is low, and vice versa, so that the arrangement results in a uniform potential gradient along the plating substrate. And this in turn, results in a uniform plating rate and uniform composition of the plated alloy along the strip.

After leaving roll 56, the strip is moved over roll 58 and through a rinsing operation similar to that used after the etching step. The strip passes through rinsing tee's 74 and 76 which are fed with rinse water through flexible hoses 78 and 80. The strip is guided through the rinsing step by additional guide rolls 82 and 84. Two catch basins 70 and 72 are provided to collect the rinse water effluent. After rinsing the strip runs through a first drying cell 86, over another guide roll 88 and through a second drying cell 90. In the drying cells heat is applied to evaporate rinse water adhering to the strip. The finished plated strip is guided over roll 92 to a take up wheel 94. Take up wheel 94 is driven by an electric motor (not shown) and its rotation tensions the strip and pulls it through the plating process.

A wide range of speeds may suitably be employed for moving strip through the plating bath and the speed is not critical. Selection of an appropriate speed may depend on factors such as the thickness of the desired deposit, the composition of the plating bath, the bath temperature and the like. Typical speeds lie in the range of about 0.005 m/sec to 0.5 m/sec. Preferred speeds were found around 0.05 to 0.4 m/sec and a more preferred range was about 0.2 to 0.25 m/sec.

In the examples shown below, an alloy composition of 80 weight percent copper and 20 weight percent zinc was plated onto metallic glass strips and wire of several different compositions employing the apparatus above described and shown in the drawing.

For comparing the quality of various platings obtained an adhesion test was developed. The adhesion test is made with 1 inch masking tape pressing the tape over the plated alloy, then the tape is gently pulled back at a 180° angle. If no brass metal adheres to the tape this will indicate a good bond between the plating and the ribbon. This test can be performed with Scotch Brand adhesive Tape No. 250 made by Minnesota Mining and Manufacturing Co., which conforms with U.S. Government Federal Specification UU-T-106*c* type II.

The particular details of the plating conditions which were found to yield adherent plating onto the glassy metal surfaces are given in the following examples.

EXAMPLE 1

The ribbon to be plated had the chemical composition $Fe_{78}Mo_2B_{20}$ (atom percent), and had a width of about 1 mm and a thickness of 0.5mm. The plating solution was of the brass type manufactured by the Harstan Chemical Corp., Brooklyn, N.Y. and sold as Harstan BSC with the chemical composition Cu 75 g/l, CuCN 85.75 g/l, Zn 18.75 g/l, $Zn(CN)_2$ 33.75 g/l, NaCN 56.25 g/l. A 10% aqueous hydrofluoroboric acid solution at room temperature was employed in the etching step. The ribbon was carried immersed in the plating bath for a length of 8 inches. The temperature of the plating bath was 45° C. The ribbon was plated at currents between 1 and 4 amps with speeds of between 34 and 44 ft/min. The plated ribbon was rinsed with hot water of about 60° C. and dried with hot air of about 40° C. The plating thickness was determined as 0.5 micron. In all cases, the plating was suitable for adhesion to rubber. When the plated ribbon was subjected to the above described adhesion test, and no plated material was sticking to the adhesive tape.

EXAMPLE 2

A metallic glass ribbon with the chemical composition $Fe_{78}Mo_2B_{20}$ was plated with brass. The etching solution employed before plating was a 10% hydrofluoric acid. The brass plating bath was identical to that employed in Example 1. The ribbon was immersed 8 inches in the plating bath. The plating bath temperature was 45° C. and the ribbon was moved through the bath at a speed of 34 ft/min. The plating current was 2.5 amps. After plating, the ribbon was rinsed with hot water. The plating, when subjected to the adhesion test, did not stick to the adhesive tape.

EXAMPLE 3

A wire of the same chemical composition as the ribbon employed in Example 2 was plated with brass following the procedure of Example 1. An about 10% to 20% by weight aqueous fluoroboric acid was employed. The plating current varied between 2 and 4 amps and the speed of the ribbon was between 34 and 43 ft/min. After rinsing with hot water and drying with hot air the wire was subjected to the adhesion test; the plated film could not be removed with an adhesive tape.

EXAMPLE 4

A metallic glass ribbon of the composition $Mo_4Co_{20}Fe_5Ni_{45}Cr_{10}B_{16}$ was employed as a plating substrate. Prior to plating, the ribbon was etched cathodically at room temperature employing a current of 0.8A in an etching solution of 1n aqueous sulfuric acid containing 5% by weight of sodium chloride, using a stainless steel anode. Following the etching operation, the ribbon was rinsed with hot water. The ribbon was then plated employing a brass plating bath identical to that employed in Example 1. The plating bath temperature was 48° C. The ribbon traveled through the plating bath at a speed of 9 ft/min and for a length of 8 inches. After the plating step, the ribbon was rinsed with hot water and dried with hot air. Various plating currents between ½ and 2 amps were used. The distance of the anode to the ribbon was varied between 0.1 inches and to 1 inch. In all cases, an adhering plating was obtained. The optimum distance between anode and ribbon was found to be about 0.25 inches.

EXAMPLES 5 AND 6

Metallic glass ribbon was plated using the materials and procedures of Example 4, but employing the etching current, plating current and plating temperature as shown in the Table below. In Example 6, the plating film adhered well to the underlying metallic glass ribbon.

EXAMPLE 7

Metallic glass ribbon, 200 mils wide with the chemical composition $Mo_4Co_{20}Fe_5Ni_{45}Cr_{10}B_{16}$ was electrochemically etched in an etching bath of 1n aqueous $H_2SO_4$ containing 5 weight percent sodium chloride using a current of 0.8A. The anode was stainless steel. A fresh plating solution of the type used in Example 1 was employed at a temperature of 48° C. A double anode consisting of two separate pieces with the ribbon in between was used which was ½ inch separated apart and each separate piece had a size of about 1 × 4 inches. The ribbon travelled between the two pieces, perpendicular to the ribbon and the speed was 30 ft/min and the plating span 8 inches. The plated ribbon was vulcanized to natural rubber stock using a curing time of about 40 min at 280° F. The rubbed adhered well to the ribbon.

EXAMPLE 8

A metallic glass ribbon of a composition $Fe_{78}Mo_2B_{20}$ having a width of 45 mils was etched in an aqueous solution of 1n sulfuric acid containing 5 weight percent sodium chloride. The process conditions are summarized in the Table below. In the adhesion test the plated deposit did not stick to adhesive tape.

EXAMPLE 9

A 5.5 mils diameter nichrome wire was cathodically etched at a current of 0.48 A in a 1n sulfuric acid solution containing 5 weight percent of sodium chloride at room temperature. The wire was then rinsed, plated, rinsed and dried under the conditions shown in the table below. The plated wire passed the adhesion test.

EXAMPLE 10

A stainless steel wire of 3 mils diameter was etched, rinsed, plated, rinsed and dried under the conditions summarized in the table below. The plated wire passed the adhesion test.

We claim:

1. A method for continuously electroplating an alloy on to electrically conductive strip comprising:
   (a) placing an anode into a plating bath adjacent to said strip, said bath adapted to electrochemically deposit an alloy therefrom and applying a positive potential to the anode;
   (b) transporting the strip submerged through the bath along a mirror symmetrical path having a mirror plane lying normal to the surface of the bath and to the direction of movement of said strip and having the anode generally bisected by said mirror plane, while applying a negative potential through a cathode contacts to the strip at at least two points about equidistant from and on opposite sides of the anode, wherein the anode extends in the direction of movement of the strip not more than about 15% of the length of the strip submerged in the bath so that submerged points of the strip distant from the cathode contact are relatively near to the anode and that the submerged points of the strip near to the cathode contact are correspondingly distant from the anode resulting in an essential uniform potential drop and current density around and along the strip.

2. A method as set forth in claim 1 with the additional steps of etching the strip by contacting it with hydrofluoroboric acid and rinsing the etched strip before electroplating said alloy.

3. A method for continuous electroplating as set forth in claim 1 wherein the distance of points along the strip submerged in the bath from the anode is a monotonically increasing function.

4. A method for continuous electroplating as set forth in claim 1 wherein the anode forms a topological torus around the moving strip.

Table

| | | | Brass Plating of Strip | | | | | | | |
|---|---|---|---|---|---|---|---|---|---|---|
| | | | ETCHING 7" SPAN S.S. ANODE | | | PLATING 8" SPAN | | | | |
| EX. | COMPOSITION OF STRIP | WIDTH MILS | I AMPS | SOLN. | RINSE | I AMPS | TEMP | SPEED FT/MIN | RINSE* | RESULTS OF ADHESION TEST |
| 1. | $Fe_{78}Mo_2B_{20}$ | 40–43 | — | 10% Fluoroboric acid | Hot Water | 1–4 | 45 | 34–44 | Hot Water | No plating sticking to tape |
| 2. | $Fe_{78}Mo_2B_{20}$ | 40–43 | — | 10% Fluoroboric acid | Hot Water | 2.5 | 45 | 34 | Hot Water | No plating sticking to tape |
| 3. | $Fe_{78}Mo_2B_{20}$ | 40–43 | — | 10–20% Fluoro Boric Acid | Hot Water | 2–4 | 45 | 34–43 | Hot water | No plating sticking to tape |
| 4. | $Mo_4Co_{20}Fe_5Ni_{45}Cr_{10}B_{16}$ | 200 | 0.8 | In $H_2SO_4$ & 5% NaCL | Hot Water | 1 | 48 | 9 | Hot Water | No plating sticking to tape |
| 5. | " | — | 0.5 | In $H_2SO_4$ & 5% NaCl | Hot Water | 0.5–1.0 | 45 | 9 | Hot Water | Plating sticking to edge smooth side |
| 6. | " | — | 0.9 | In $H_2SO_4$ & 5%NaCl | Hot Water | 0.5–1.0 | 47 | 9 | Hot Water | No plating sticking to tape |
| 7. | $Mo_4Co_{20}Fe_5Ni_{45}Cr_{10}B_{16}$ | 200 | 0.8 | In $H_2SO_4$ & 5% NaCl | Hot Water | 2.0 double anode | 48 | 9 | Hot Water | No plating sticking to tape |
| 8. | $Fe_{78}Mo_2B_{20}$ | 45 | 1.0 | In $H_2SO_4$ & 5% NaCl | Hot Water | 1.0–4.0 | 47 | 50 | Hot Water | No plating sticking to tape |
| 9. | Nichrome wire | 5.5DIA. | 0.48 | In $H_2SO_4$ & 5% NaCl | Cold Water | 0.3–3.0 | 45 | 52 | Cold Water | No plating sticking to tape |
| 10. | Stainless Steel Wire | 3.0Dia | 0.28 | In $H_2SO_4$ & 5%NaCl | Cold Water | 0.5–3.0 | 46 | 52 | Cold Water | No plating sticking to tape |

Temperature of etching bath: 25° C; Plating Solution type HARSTAN BSC; Drying after final rinse took place in hot air.
*Hot water at about 60° C.

5. A method as set forth in claim 1 wherein the electrically conductive strip is a strip of metallic glass and which includes the additional steps of etching the metallic glass strip prior to transporting it through the plating bath by placing the strip in an etching bath comprising a nonoxidizing inorganic acid and chloride ions and applying a negative potential to the strip.

6. A method as set forth in claim 1 wherein the negative potential applied to the strip results in an average current density of at least 5 amp/dm on the immersed surface of the strip.

7. An apparatus for continuously electroplating an alloy onto electroconductive strip comprising:

(a) means for containing a plating bath adapted to electrochemcially deposit an alloy therefrom;

(b) an anode placed within the plating bath adjacent to said strip;

(c) means for transporting the metallic strip through the plating bath along a mirror symmetrical path having a mirror plane lying normal to the surface of the bath and to the direction of movement of said strip and having the anode generally bisected by said mirror plane; and (d) contact means for applying a negative potential to the strip at at least two points about equidistant from and on opposite sides of the anode, wherein the anode extends in the direction of movement of the strip not more than about 15 percent of the length of the strip submerged in the bath.

8. An apparatus as set forth in claim 7 including rotatable contacts for securely guiding the strip.

9. An apparatus as set forth in claim 7 wherein the anode surronds the strip through an angle of at least 240°.

* * * * *

UNITED STATES PATENT AND TRADEMARK OFFICE

CERTIFICATE OF CORRECTION

PATENT NO. : 4,128,459

DATED : December 5, 1978

INVENTOR(S) : Gerald R. Bretts, Dirk A. Timan

It is certified that error appears in the above-identified patent and that said Letters Patent are hereby corrected as shown below:

Col. 1, line 54, "as" should read --are--

Col. 7, line 9, "at" should read --is--

Col. 9, line 1, "eteched" should read --etched-- line 12, "rubbed" should read --rubber--

Col. 9 and 10 in table, Ex. 4., "5% NaCL" should read --5% NaCl--

Col. 11, line 16, "electrochemcially" should read --electrochemically--

Col. 12, line 16, "surronds" should read --surrounds--

Signed and Sealed this

*Thirteenth* Day of *January 1981*

[SEAL]

*Attest:*

SIDNEY A. DIAMOND

*Attesting Officer*

*Commissioner of Patents and Trademarks*